US011576838B1

(12) United States Patent
Callow

(10) Patent No.: US 11,576,838 B1
(45) Date of Patent: Feb. 14, 2023

(54) GRIP

(71) Applicant: Perfect FIT BRAND, INC., Fort Lauderdale, FL (US)

(72) Inventor: Stephen Callow, Los Angeles, CA (US)

( * ) Notice: Subject to any disclaimer, the term of this patent is extended or adjusted under 35 U.S.C. 154(b) by 0 days.

(21) Appl. No.: 17/548,361

(22) Filed: Dec. 10, 2021

(51) Int. Cl.
*A61H 19/00* (2006.01)
*A61H 21/00* (2006.01)

(52) U.S. Cl.
CPC ..... *A61H 19/44* (2013.01); *A61H 21/00* (2013.01); *A61H 2201/0153* (2013.01); *A61H 2201/1638* (2013.01)

(58) Field of Classification Search
CPC ..... A61H 19/00; A61H 19/40; A61H 19/44; A61H 21/00
See application file for complete search history.

(56) References Cited

U.S. PATENT DOCUMENTS

| | | | | | |
|---|---|---|---|---|---|
| 2,913,080 | A * | 11/1959 | Louik | A45C 13/26 | D8/316 |
| D188,582 | S * | 8/1960 | Koffler | D8/316 | |
| D207,470 | S * | 4/1967 | Unter et al. | D8/316 | |
| 3,958,731 | A * | 5/1976 | Riedle | A45F 5/102 | 224/250 |
| 4,187,628 | A * | 2/1980 | Thompson | A45C 13/42 | 428/101 |
| 2008/0139980 | A1* | 6/2008 | Fladl | A61H 19/34 | 601/70 |
| 2014/0323929 | A1* | 10/2014 | Iurchenko | A61H 19/40 | 601/46 |
| 2017/0095397 | A1* | 4/2017 | Barnard | A61H 23/02 | |
| 2017/0266076 | A1* | 9/2017 | Chen | A61H 19/34 | |

* cited by examiner

*Primary Examiner* — John P Lacyk
(74) *Attorney, Agent, or Firm* — Assouline & Berlowe, PA; Peter A. Koziol, Esq.

(57) ABSTRACT

A grip for sexual articles like butt-plugs, anal beads and dildos that enables better control through a flexible finger attachment that is collapsible for comfortable sitting while the sexual article is being used.

20 Claims, 12 Drawing Sheets

GRIP

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to the fields of grips for sexual health devices, sex toys, and medical devices. The invention provides a solution for an improved grip that can be used with one or more fingers. The invention enables better, more secure and comfortable control sexual health devices, sex toys, and medical devices and particularly for butt plugs, dildos and anal beads. It also enabled to compact for use while sitting and provides attachment for additional grips and straps, providing uses for chastity play and various adult games and sexual activities.

Description of the Related Art

Conventional butt-plugs, dildos and anal beads are often used in sexual play, but generally lack a secure, comfortable, and flexible means for holding them during use or for easy insertion, and removal. Prior art either lacks a grip or merely provides synthetic tails, strings and rigid pulls that do not offer the benefits and improvements described herein. As described herein, the invention may be used alone or conjunction with prior art pulls whether rigid or flexible and it provides a novel connection to straps and other pulls.

SUMMARY OF THE INVENTION

The present provides an improved grip for butt-plugs, dildos, anal beads and other devices used during sexual play (generally "Sexual Articles"). The invention provides more control, security, comfort and flexibility for holding and using Sexual Articles.

More specifically, the grip enables a Sexual Article to be comfortably secured to a controlling user's fingers and allows for more precise control during sexual activity and various adult games. It is easy to use and manufacture and can be made to be seamless with the Sexual Article to which it is connected.

With the invention of the grip disclosed herein now users can attempt previously avoided sexual activities with new confidence, comfort and pleasure. The invention enables greater control of Sexual Articles and improved comfort for a controlling user's fingers and hand, while compacting while a user is donning a Sexual Article so that the grip is comfortable while the donning user is sitting and/or wearing for an extended period of time. The invention also enables various sexual articles to be secured through the use of straps and/or harnesses.

Although the invention is illustrated and described herein as embodied as a grip, the invention is not limited to the details shown because various modifications and structural changes may be made without departing from the invention and the equivalents of the claims. However, the construction and method of operation of the invention together with additional objects and advantages thereof will be best understood from the following description of specific embodiments when read in connection with the accompanying drawings.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

Figure 1:
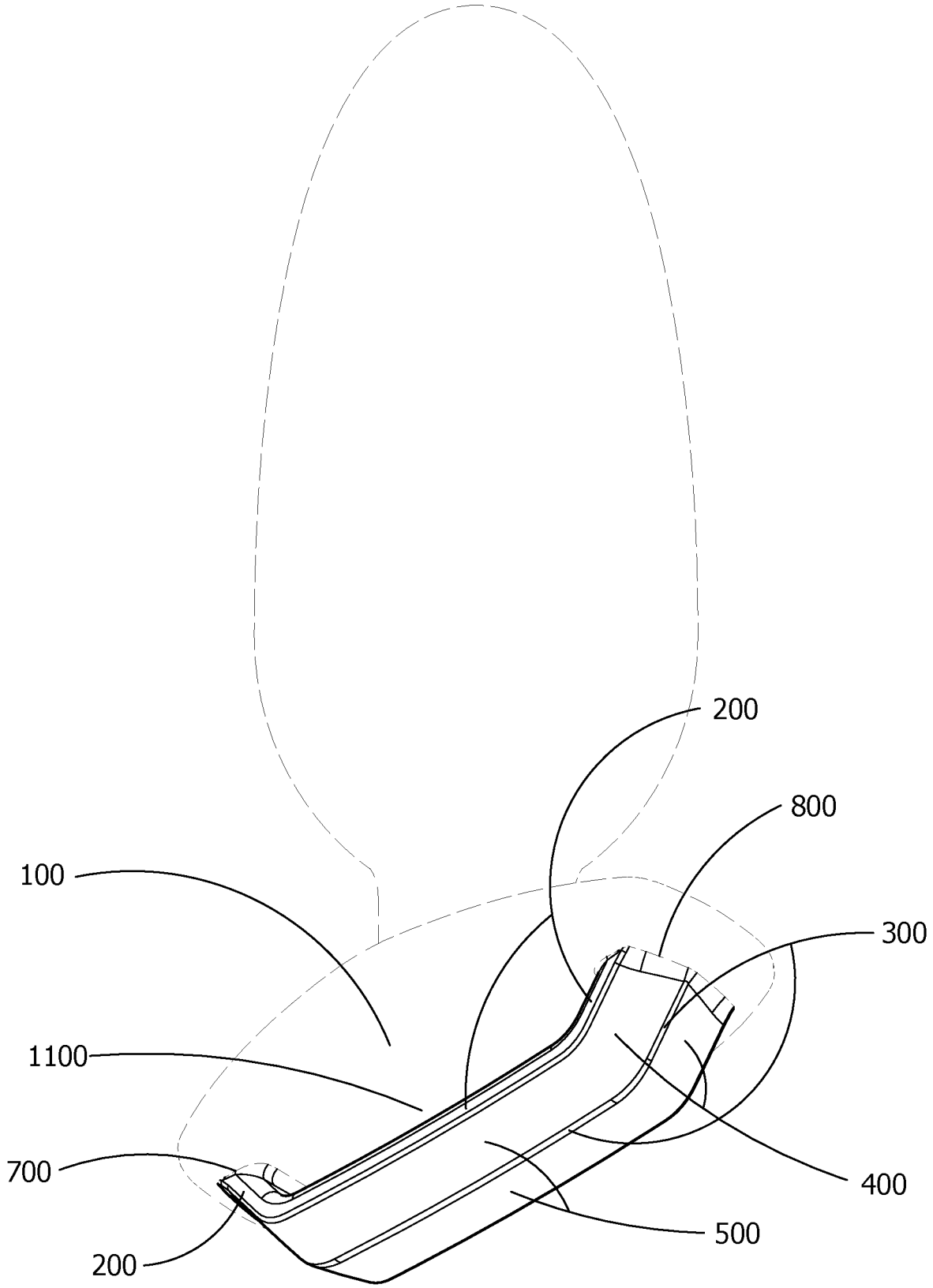
FIG. 1 is a front perspective view of the invention taken from the invention towards a butt-plug.

Referring to the drawings, FIG. 1 is a front perspective view of the invention taken from the invention towards a butt-plug. The butt-plug in the drawing is an example of one of many types of sexual articles that might use the grip of the invention. Generally, the grip is sized so that it may elastically attach to one or more fingers depending on the article and type of use for sexual activity or other medical purposes. Pictured in FIG. 1 are: a) base 100 of the Sexual Article; b)

outer-sidewall 200; c) median 300; d) outer angled grip surface 400; e) outer grip surface 500; f) connection point A; and, g) connection point B-n. Together these elements surround the grip opening 1100.

Ring sizes often range from size 4.5 to size 10 which are about 15 mm to 20 mm in diameter or about 47-64 mm ins circumference. Thus, in preferred embodiments the diameter of a grip opening designed for a single finger should be just below 15 mm, but have the ability to stretch to 20 mm or greater. Other values in this range also provide more comfortable fit and control depending on the intend use and personal preference. Larger diameters and circumferences enable the grip to be secured to more fingers. Smaller diameters provide more secure use and fit for smaller fingers. In many cases, it is preferred to keep the general diameter from the Sexual Article to the grip within the lower diameters of about 15-17 mm while extending the length of the grip to be adapted to accommodate multiple fingers with overall horizontal diameters exceeding 30 mm or more for two fingers and 45-50 mm and more for three or more fingers. In the drawings and in one of the embodiments disclosed herein the grip opening 1100 generally forms a trapezoidal shape. The trapezoidal shape of the grip opening provides better comfort and more secure fitting, and may take the better balanced isosceles trapezoid form, parallelogram form, or non-parallelogram trapezoidal form depending on actual or intended attached Sexual Article. Also, the grip opening may form various other shapes such as elliptical, circular, rectangular or amorphous. Although the sizes of the various sides of the trapezoidal form may vary it is generally preferred that the base side of the trapezoid range from 4 cm-6 cm, and the inner grip surface farthest from the article and between the angled inner wall surfaces (opposite of the outer wall surfaces) ranges from 3-5 cm. The distance of the farthest inner wall surface to the base of the article generally being just less than half of a centimeter (~0.4 cm) to about a centimeter from the base. A preferred size when relaxed generally being about one-half (0.5) to 0.75 cm, but stretching to accommodate one or more fingers.

Figure 2:
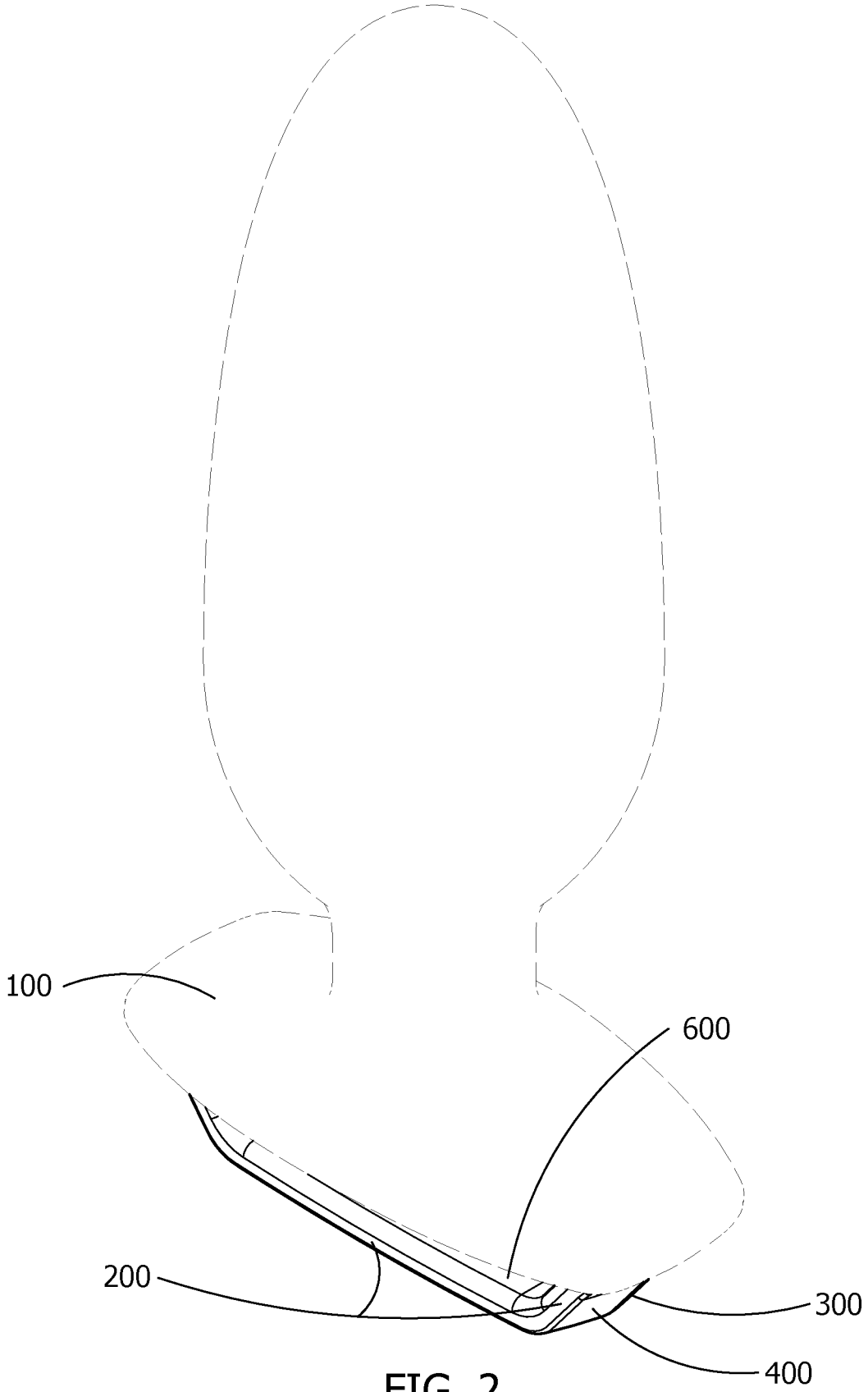
FIG. 2 is the opposite perspective view of the invention taken from a butt-plug towards the invention.

As shown in FIG. 2, the opposite perspective view of the invention taken from a butt-plug towards the invention. Shown are:

a) base 100 of the Sexual Article; b) outer-sidewall 200; c) median 300; d) outer angled grip surface 400; and, g) inner grip surface 600.

Figure 3:
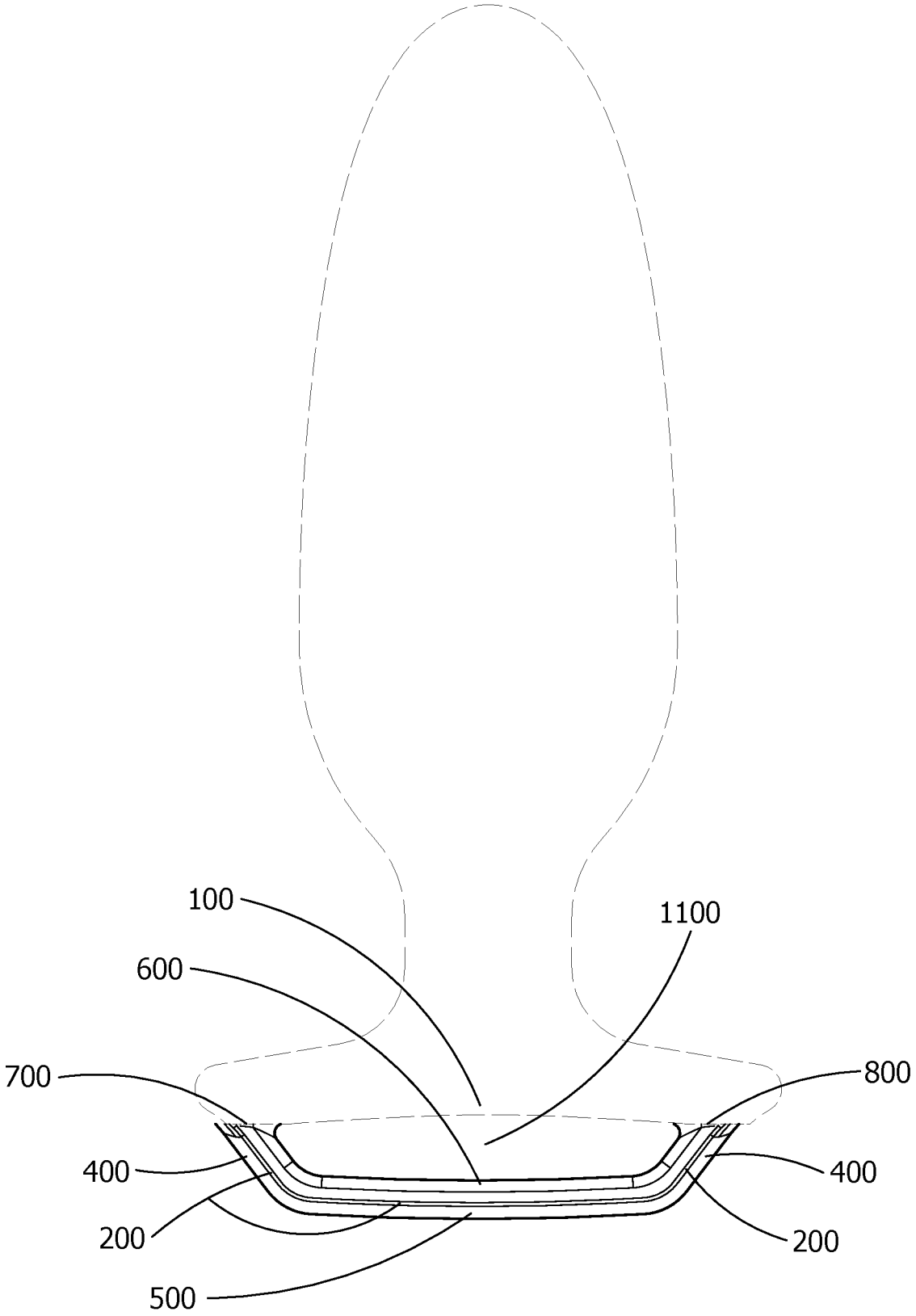
FIG. 3 is a front view of the invention.

As shown in FIG. 3, front view of the invention, the invention is generally secured to at least two points on the sexual article, namely: a) connection point A 700; and b) connection points B-n 800. The base 100 of the Sexual Article and grip structure creating a closed loop surrounding the grip opening 1100 for use with one or more fingers. It is preferred, but not required that the grip be molded with the Sexual Article and made of the same or similar material as the Sexual Article for easier manufacturing, comfort use and cleanliness. It is generally preferred that a silicone material, silicone blend, plastic, rubber, TPR, TPE or other similar material be used for the grip.

In some embodiments the grip may be secured to more than two places, particularly if it is being used to directly attached to more than one finger. However, for most applications the simplicity of the inventions requires only one grip opening 1100.

In many embodiments the grip is molded into the article for better structural control, uniformity and easy of manufacturing/use, in some applications the grip is removeable and re-attachable to the article by use of various fastening means such as glues, snaps, hook and loop, slots, straps, etc at connection point A 700 and connections point B-n 800. These alternative embodiments of a removable grip allows for the sexual device to have a lower profile while in use, but lack the benefits of the single mold or otherwise combined Sexual Article design.

Figure 4:
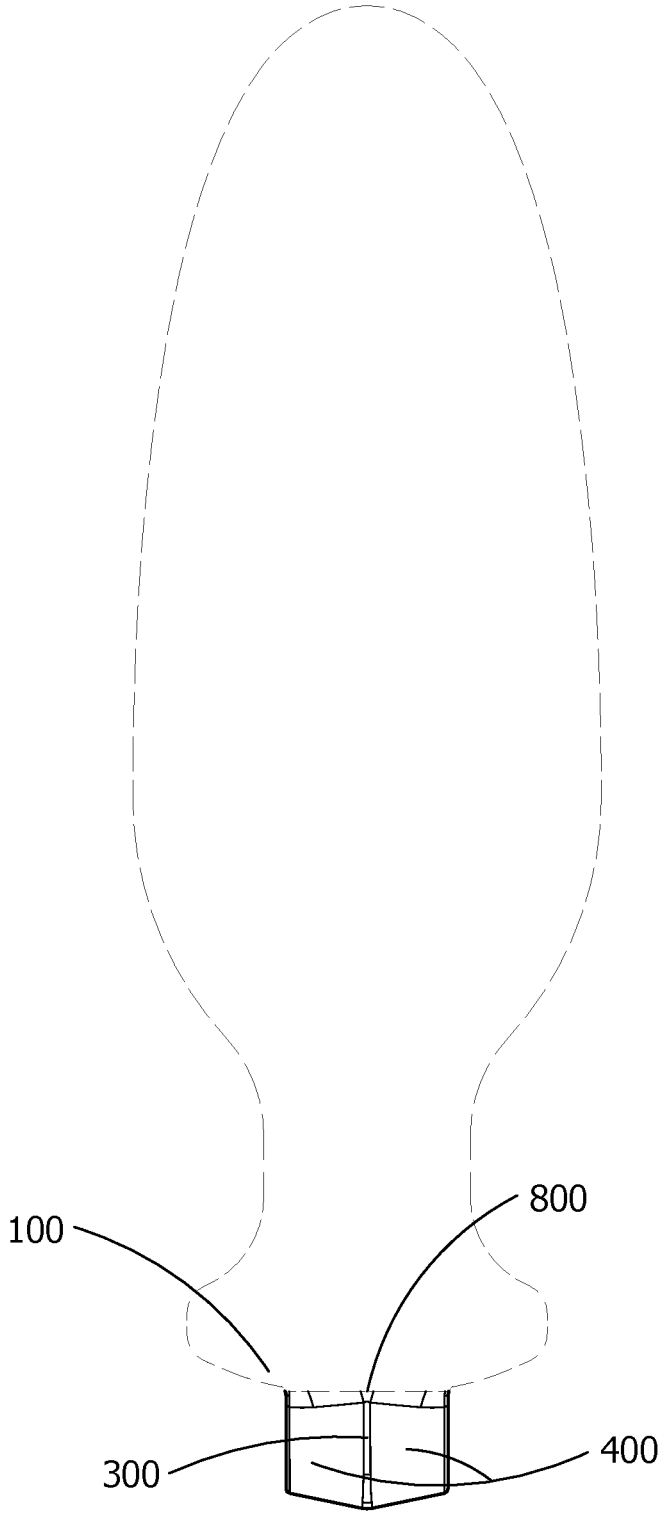
FIG. 4 is a side view of the invention.

FIG. 4 is a side view of the invention, annotated is outer angled grip surface 400, base of the Sexual Article 100; connection point B-n 800, median 300 and outer angled grip surface 400. Opposite of the outer angled grip surface is the inner angled grip surface.

Figure 5:
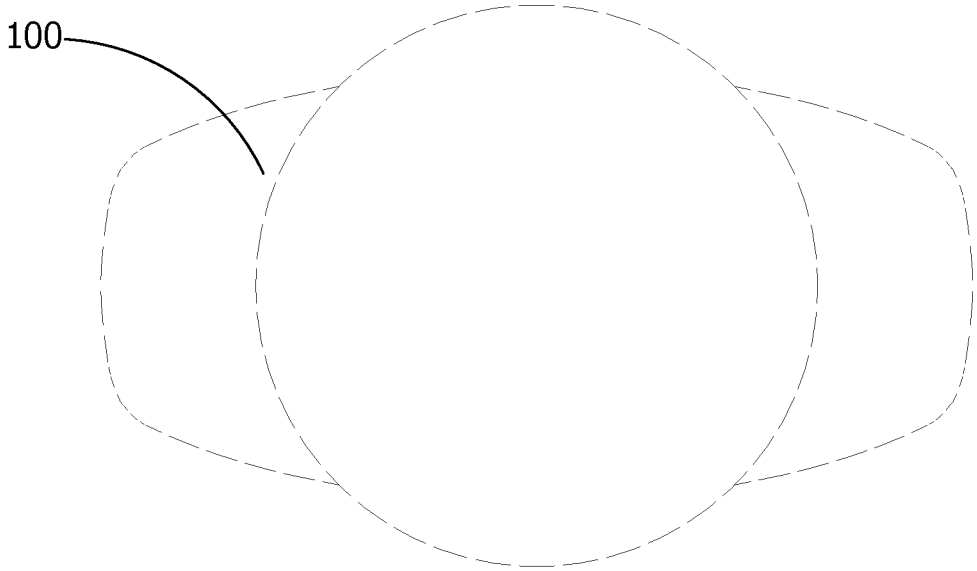
FIG. 5 is a plan view of a butt-plug obscuring the view of the invention.

FIG. 5 is a plan view of a butt-plug, the base 100 of the sexual article (the butt-plug) obscuring the view of the invention.

Figure 6:
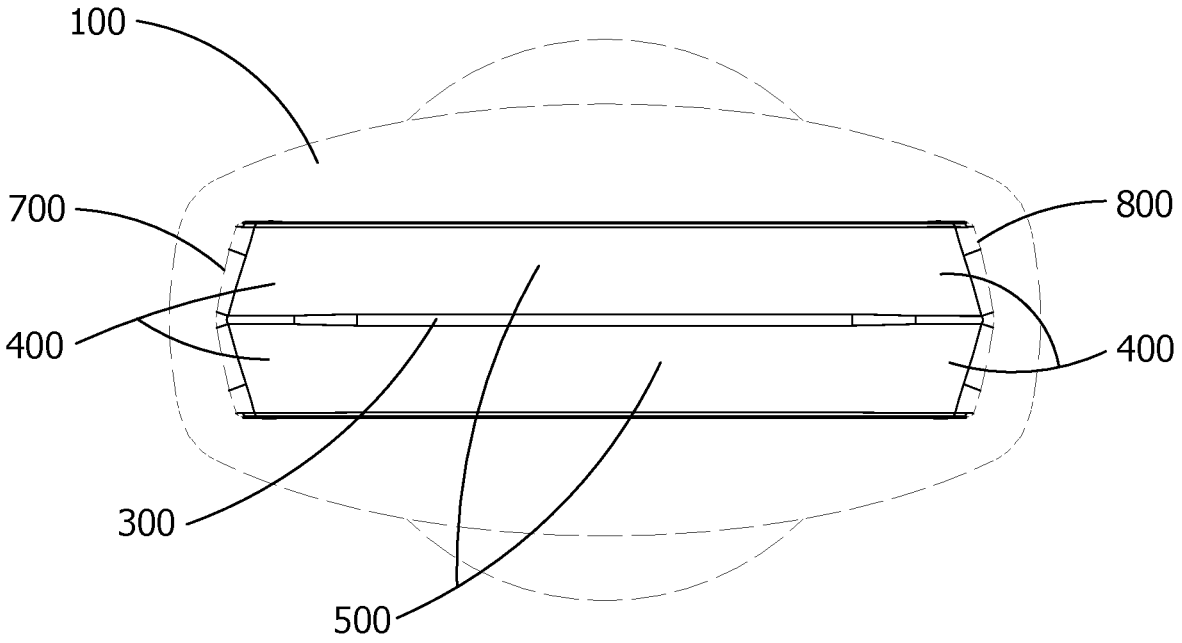
FIG. 6 is a plan view the invention in front of a butt-plug.

FIG. 6 is a plan view the invention in front of a butt-plug. Shown are: a) base 100 of the Sexual Article; b) median 300; c) outer angled grip surface 400; d) outer grip surface 500; e) connection A; and f) connection B-n.

Figure 7:
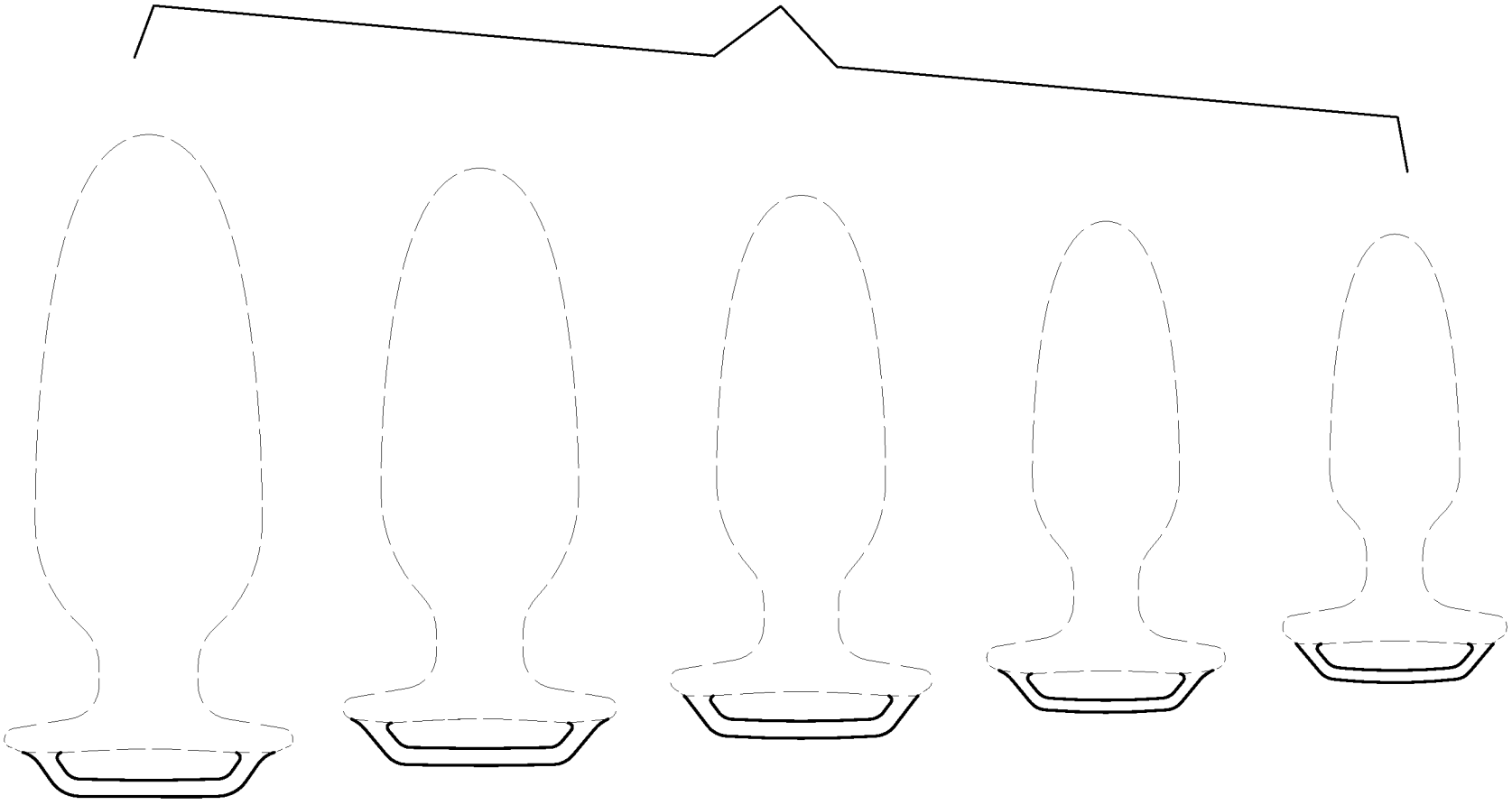
FIG. 7 is a front view of examples of the invention of varying sizes.

FIG. 7 is a front view of examples of the invention of varying sizes.

Figure 8:
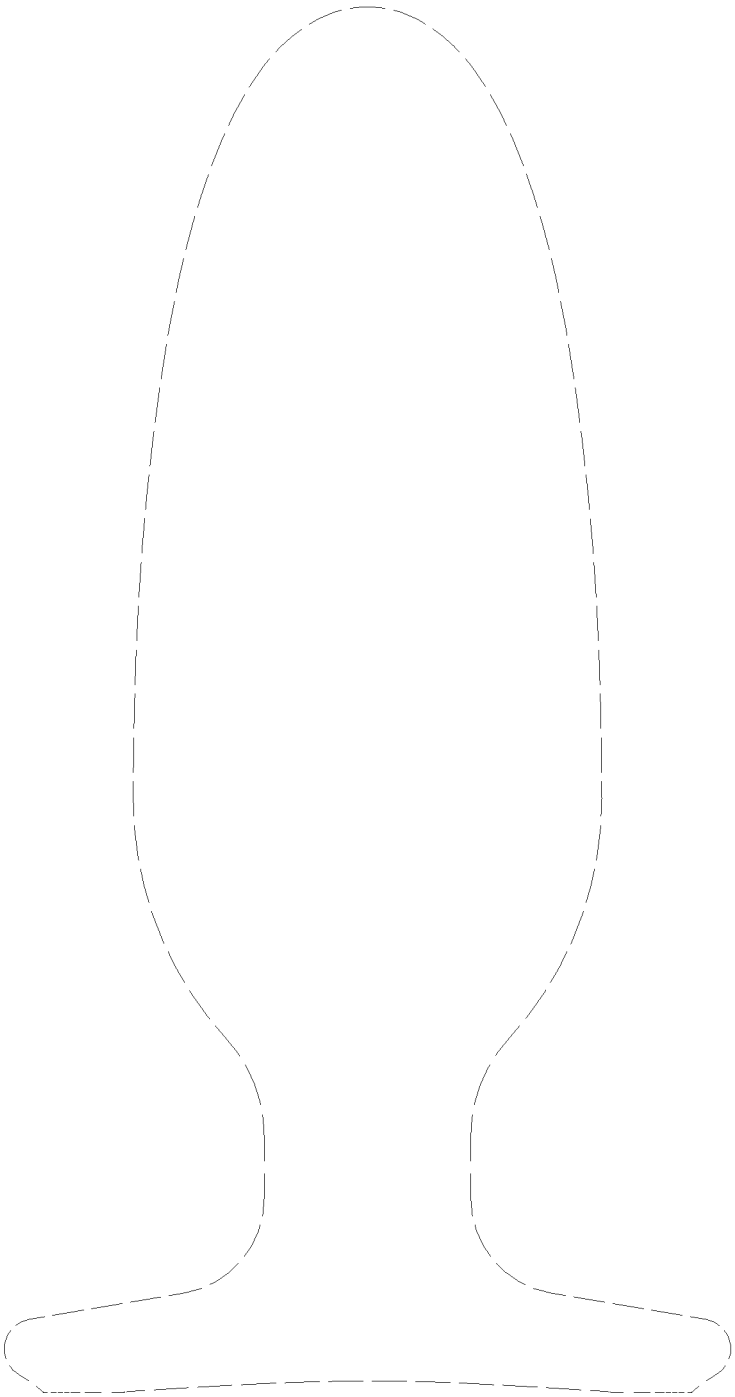
FIG. 8 PRIOR ART
FIG. 8 is a front view of prior art that lacks the invention.

FIG. 8 is a front view of prior art that lacks the invention.

Figure 9:
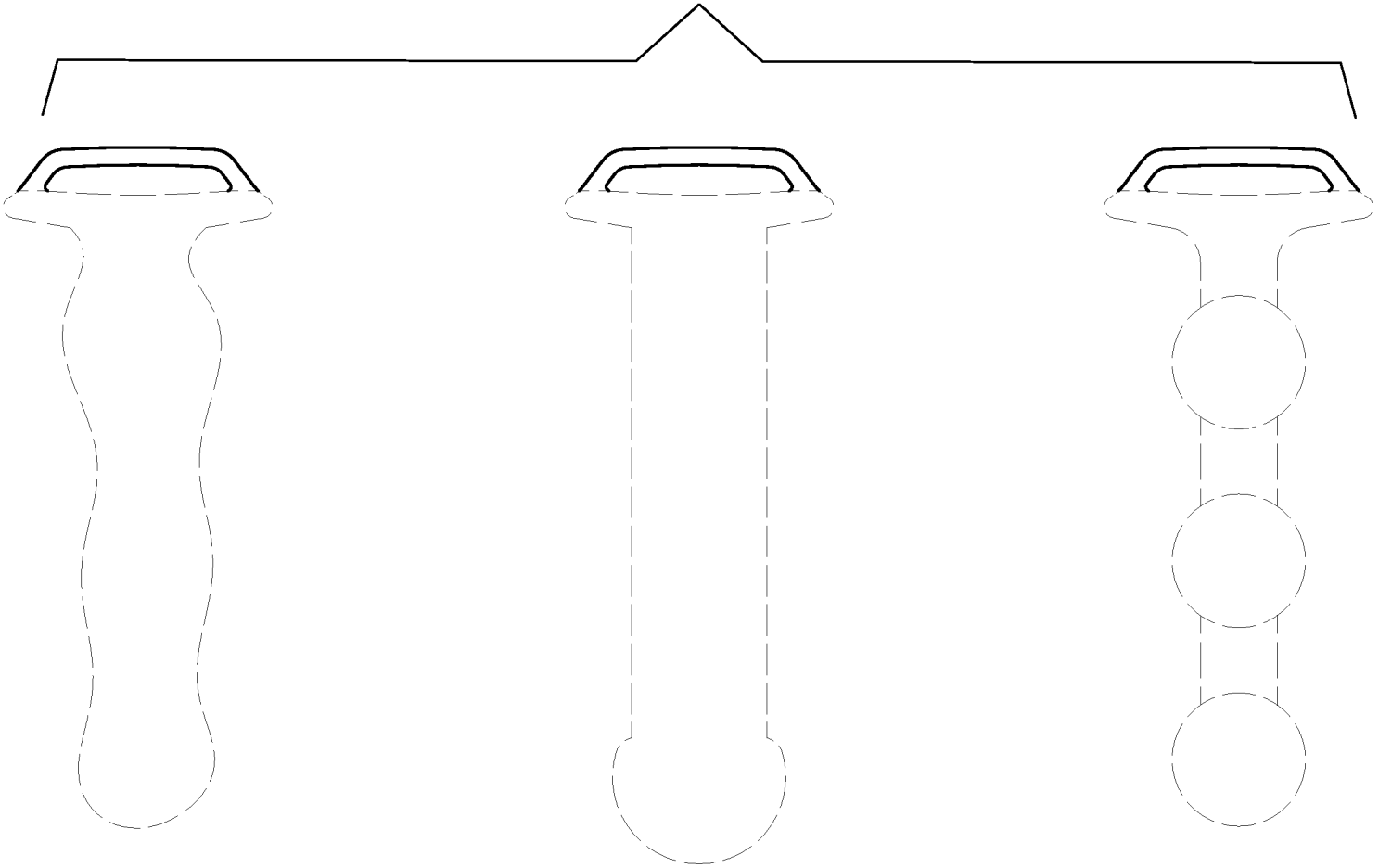
FIG. 9 is a front view of the invention in use with varying dildos, butt-plugs and beads.

FIG. 9 is a front view of the invention in use with varying dildos, butt-plugs and beads.

Figure 10:
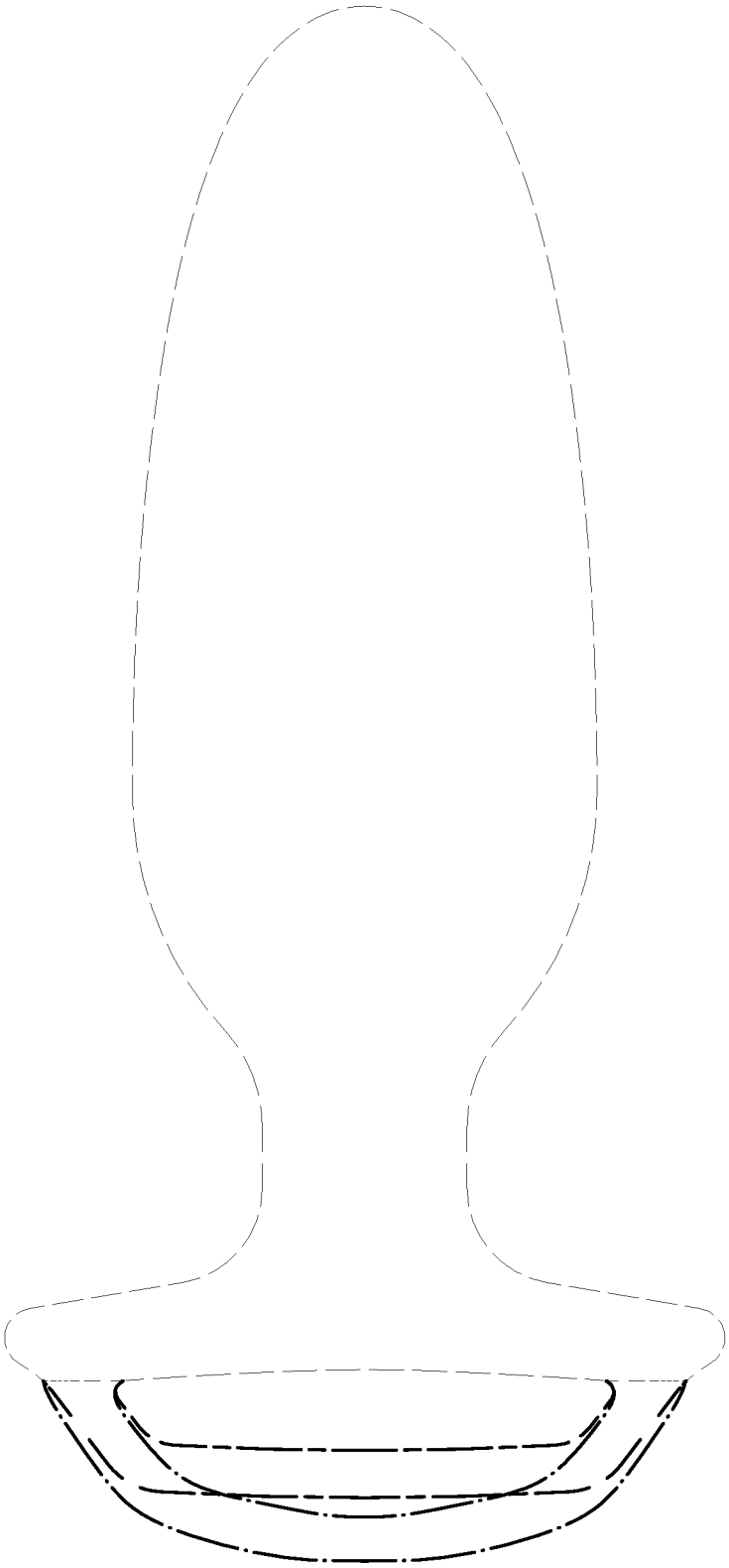
FIG. 10 is a front view of the invention illustrating alternative positions due to the elasticity of embodiments of the invention.

FIG. 10 is a front view of the invention illustrating alternative positions due to the elasticity of embodiments of the invention.

Figure 11:
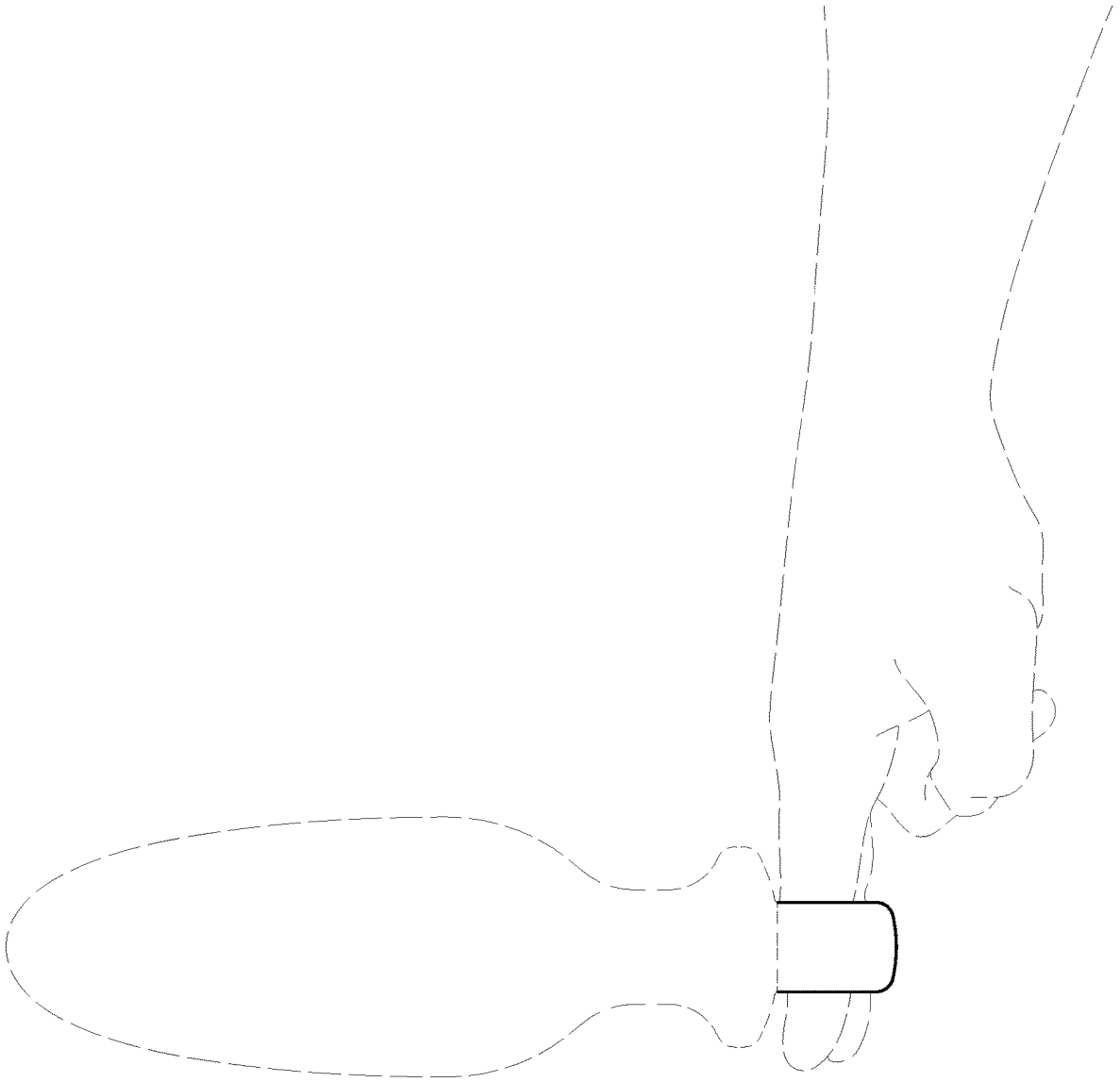
FIG. 11 is a side view of the invention illustrating the use and fitting of the invention for one or more fingers.

FIG. 11 is a side view of the invention illustrating the use and fitting of the invention for one or more fingers. In most applications the invention is molded with the Sexual Article so the space between the grip and the base of the associated Sexual Article is less than the thickness of a finger. Thus, the invention and base of the Sexual Article hold the device securely on the finger. A user does not need to close the user's fingers to grip it.

Figure 12:
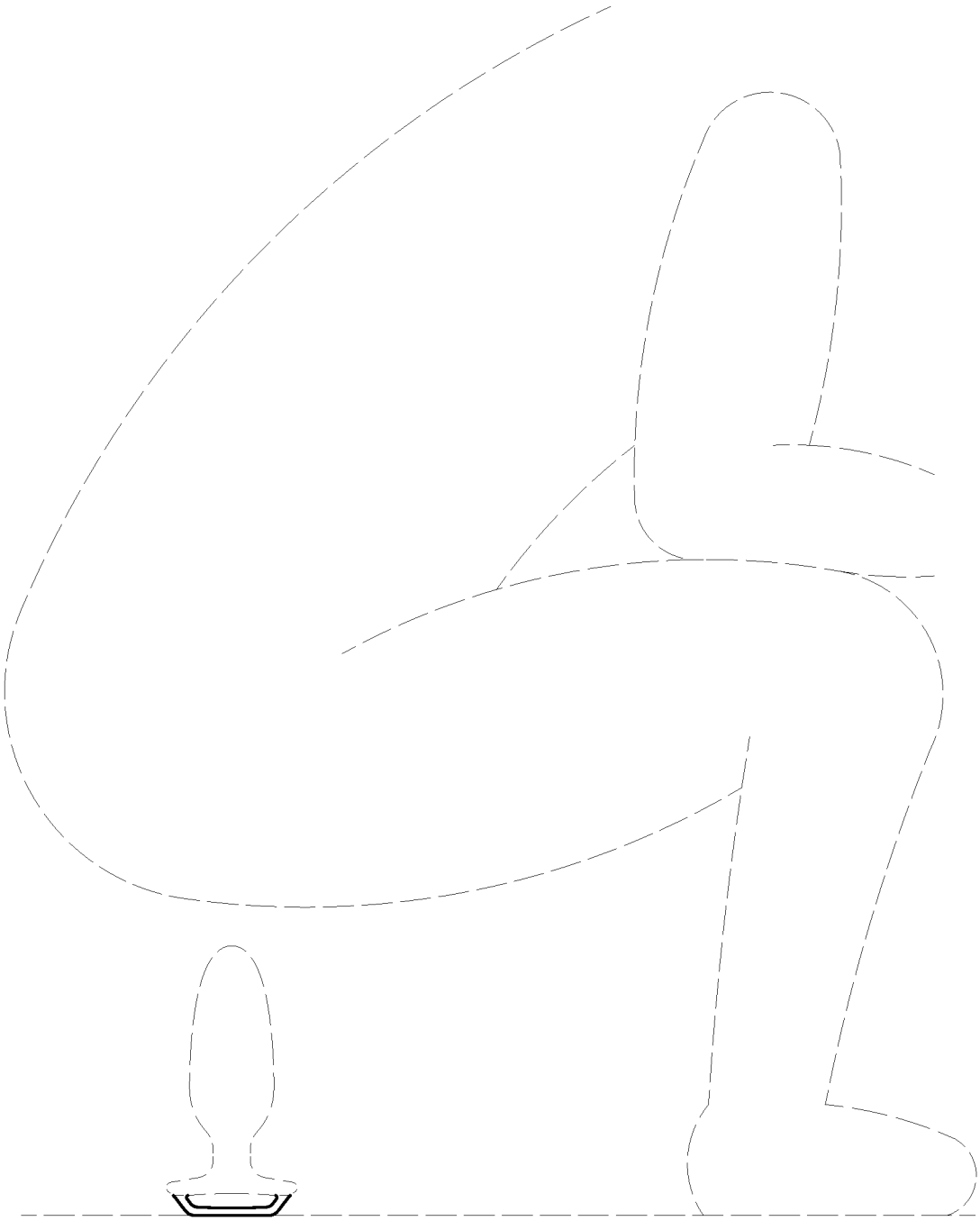
FIG. 12 is a front view of the invention illustrating with broken lines how the invention may be sat upon; and, FIG. 13 is a plan view the invention in front of the butt-plug illustrating how the invention may be used to secure straps and an additional pull or grip a shown in an exemplary toroidal ring form.

FIG. 12 is a front view of the invention illustrating with broken lines how the invention may be sat upon. Using a flexible material for the device and shorter diameter between the grip and the base of the Sexual Article enables the grip to compress into a low profile for sitting and regular (all day) use.

Figure 13:
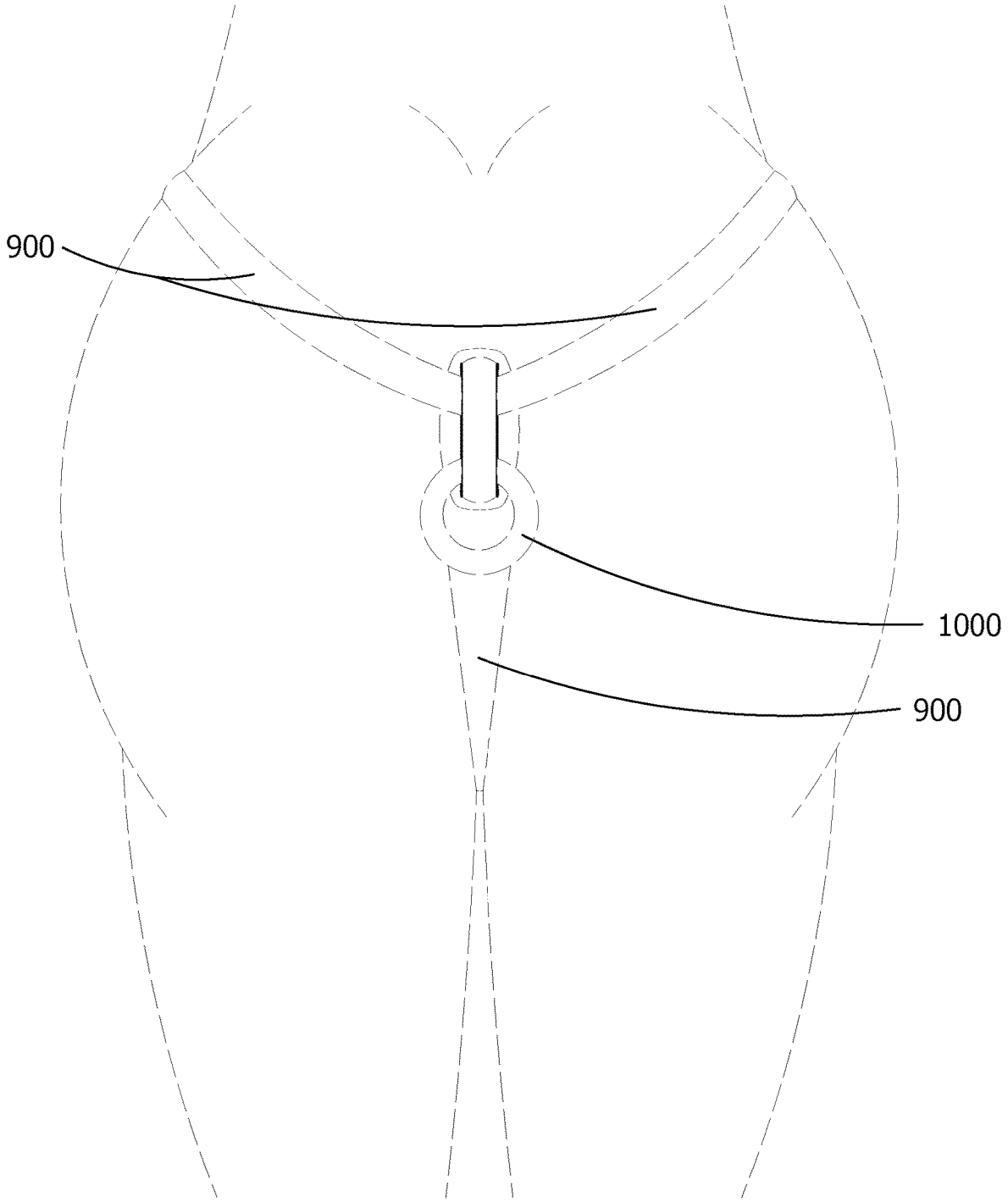

FIG. 13 is a plan view the invention in front of the butt-plug illustrating how the invention may be used to secure straps and an additional pull 1000, which is an example of various attachable grips, rings and ornaments. The grip can not only be connected to one or more strap 900 or harnesses to secure the Sexual Article in place during use, but also to hang it up for storage by the strap 900 or pull 1000 after sexual activity.

The drawings herein are understood to be just representative embodiments, other embodiments and combinations are also described herein.

Having thus described preferred embodiments, it should be apparent to those skilled in the art that certain advantages of the described system have been achieved. It should also be appreciated that various modifications, adaptions, and alternative embodiments thereof may be made within the scope and spirit of the present invention. The invention is further defined by the following claims.

What is claimed is:

1. A sexual article combined with a grip comprising:

one or more outer-sidewall;

one or more outer angled grip surface;

one or more outer grip surface;

one or more inner grip surface;

a connection point A;

one or more connection points B-n;

wherein the grip attaches to a base of the sexual article at the connection point A and the one or more connection points B-n forming a grip opening adapted to elastically secure the grip and the sexual article to one or more fingers with a compression fit.

2. The sexual article combined with a grip of claim 1 wherein the grip comprises a molded loop of at least one or more of silicone and thermoplastic.

3. The sexual article combined with a grip of claim 1 wherein the grip and sexual article consist of an elastic material.

4. The sexual article combined with a grip of claim 1 wherein the grip opening between the inner surface of the grip and the base of the sexual article is adapted to be 15 mm or less at rest and stretchable to a larger diameter.

5. The sexual article combined with a grip of claim 1 wherein the grip opening between the inner surface of the grip and the base of the sexual article is adapted to be 15 mm or less and is longer in diameter between the outer-sidewall.

6. The sexual article combined with a grip of claim 1 secured in place with a strap that is connectively associated with the grip.

7. The sexual article combined with a grip of claim 1 further comprising a pull connectively associated with the grip.

8. The sexual article combined with a grip of claim 1 that is adapted to compress when sat upon.

9. The sexual article combined with a grip of claim 1 wherein the grip opening is trapezoidal.

10. The sexual article combined with a grip of claim 1 wherein the grip opening is isosceles trapezoidal.

11. The sexual article combined with a grip of claim 1 wherein the grip opening is parallelogrammical.

12. The sexual article combined with a grip of claim 1 wherein the grip opening is elliptical.

13. The sexual article combined with a grip of claim 1 wherein the grip opening is circular.

14. The sexual article combined with a grip of claim 7 wherein the pull is a ring.

15. The sexual article combined with a grip of claim 9 wherein the base adjoining side of the trapezoidal grip opening ranges from 4 cm-6 cm.

16. The sexual article combined with a grip of claim 9 wherein the distance from the inner wall surface to the base of the sexual article ranges from 0.4 to 1 cm.

17. The sexual article combined with a grip of claim 9 wherein the distance from the inner wall surface to the base of the sexual article ranges one-half (0.5) to 0.75 cm.

18. The sexual article combined with a grip of claim 9 wherein the inner grip surface farthest from the sexual article ranges from 3-5 cm.

19. The sexual article combined with a grip of claim 9 wherein the sexual article is a butt-plug.

20. The sexual article combined with a grip of claim 10 wherein the sexual article is a dildo.

* * * * *